US005727961A

United States Patent [19]

Landis et al.

[11] Patent Number: 5,727,961

[45] Date of Patent: Mar. 17, 1998

[54] TWO-WAY TRANSVERSELY MATABLE ELECTRICAL CONNECTOR

[75] Inventors: John Michael Landis, Camp Hill; George Harold Douty, Mifflintown, both of Pa.

[73] Assignee: The Whitaker Corporation, Wilmington, Del.

[21] Appl. No.: 641,246

[22] Filed: Apr. 30, 1996

[51] Int. Cl.[6] ..... H01R 13/28

[52] U.S. Cl. ..... 439/287; 439/660

[58] Field of Search ..... 439/284, 287, 439/660, 732, 376, 342, 676, 857, 293, 295

[56] References Cited

U.S. PATENT DOCUMENTS

| | | | |
|---|---|---|---|
| 3,192,445 | 6/1965 | Evans et al. | 361/732 |
| 3,245,024 | 4/1966 | Evans et al. | 439/67 |
| 3,264,525 | 8/1966 | Swengel, Sr. et al. | 361/732 |
| 3,299,392 | 1/1967 | Evans et al. | 439/62 |
| 3,411,130 | 11/1968 | Bushey | 439/660 |
| 3,469,448 | 9/1969 | Swengel, Sr. | 116/216 |
| 3,715,629 | 2/1973 | Swengel, Sr. | 361/733 |
| 5,472,347 | 12/1995 | Nordenstrom et al. | 439/61 |
| 5,508,886 | 4/1996 | Bernecker et al. | 361/733 |
| 5,575,674 | 11/1996 | Davis et al. | 439/284 |
| 5,588,877 | 12/1996 | Davis et al. | 439/660 |

OTHER PUBLICATIONS

*Wago Brochure*, "Wago I/O System: Fieldbus Independent Bus Terminal Blocks", Apr. 1996; six pages; Wago Corporation, Brown Deer, WI 53223.

U.S. Patent Application Serial No. 08/08/361,608 filed Dec. 22, 1994 (Abstract and Drawings only included).

*Primary Examiner*—Neil Abrams
*Assistant Examiner*—Barry M. L. Standig
*Attorney, Agent, or Firm*—Anton P. Ness

[57] ABSTRACT

An electrical connector (10) includes a row of contact blade portions (26) alternating with contact receptacle portions (20) all oriented orthogonally to said row, with the receptacle portions disposed in slots (22) of projections (24) of the housing (12) and adapted to receive corresponding blade portions into the slots of the projections from either side thereof. Each blade portion (26) is disposed in a recess (28) between adjacent projections (24) with the recess being slightly wider than a projection. The connector (10) is hermaphroditic and matable with another like connector (10A) by being moved transversely relative to the other with the blade portions (26) entering slots (22) of the other to be mated with receptacle portions (20) therein.

12 Claims, 7 Drawing Sheets

TWO-WAY TRANSVERSELY MATABLE ELECTRICAL CONNECTOR

FIELD OF THE INVENTION

This relates to the field of electrical connectors and more particularly to connectors having blade and receptacle contacts.

BACKGROUND OF THE INVENTION

Electrical connectors are known having blade type contacts and complementary receptacle type contacts disposed along mating faces of a pair of connectors that are matable along opposed mating interfaces. It is well known to provide such matable connectors that are adapted to be mated along a mating axis that is orthogonal to the mating faces of the opposed connectors.

It is desired to provide a pair of matable connectors securable along sidewalls of the housings of a pair of electronic articles, wherein the articles are to be closely spaced together in an array with each module adapted to be removable from the array and replaceable thereinto. The connectors must be adapted to be matable and unmatable through insertion and removal of the articles from the array.

It is further desired that the matable connectors be hermaphroditic and thus each be matable with another connector like itself.

SUMMARY OF THE INVENTION

The present invention provides a connector having an array of blade contacts extending forwardly from a housing body alternating along the mating interface with a like plurality of receptacle contacts. Each of the receptacle contacts includes a receptacle contact portion housed within a vertical through-slot of a protective projection extending orthogonally forwardly from the housing body. Each of the blade contacts has a blade housing portion extending forwardly from the housing body and being disposed within a recess between adjacent ones of the projections having the receptacle contact sections therein, wherein each recess is only slightly wider than the width of one of the projection. The blade portions and the receptacle portions extend forwardly from the housing body in a mating interface zone of limited axial dimension, and the mating zone is adapted to mate with a mating zone of a like connector that is matable when the like connector is movable transversely with respect to the mating zone, and further is matable transversely from either direction. During such mating each blade portion is adapted to be received into the slot of a projection housing an associated receptacle portion of the mating connector and thus the connectors can be said to be hermaphroditic with respect at least to their mating interfaces. The blade portions and the receptacle portions are spaced precisely equally along the mating face and are identical in number with a receptacle portion at one end of the mating face and a blade portion at the other end of the mating face. The connectors may further have alignment features to assure that the connectors are aligned with each vertically prior to engagement of their respective blade and receptacle contact portion.

An embodiment of the present invention will now be described by way of example with reference to the accompanying drawings.

DETAILED DESCRIPTION

Figure 2:
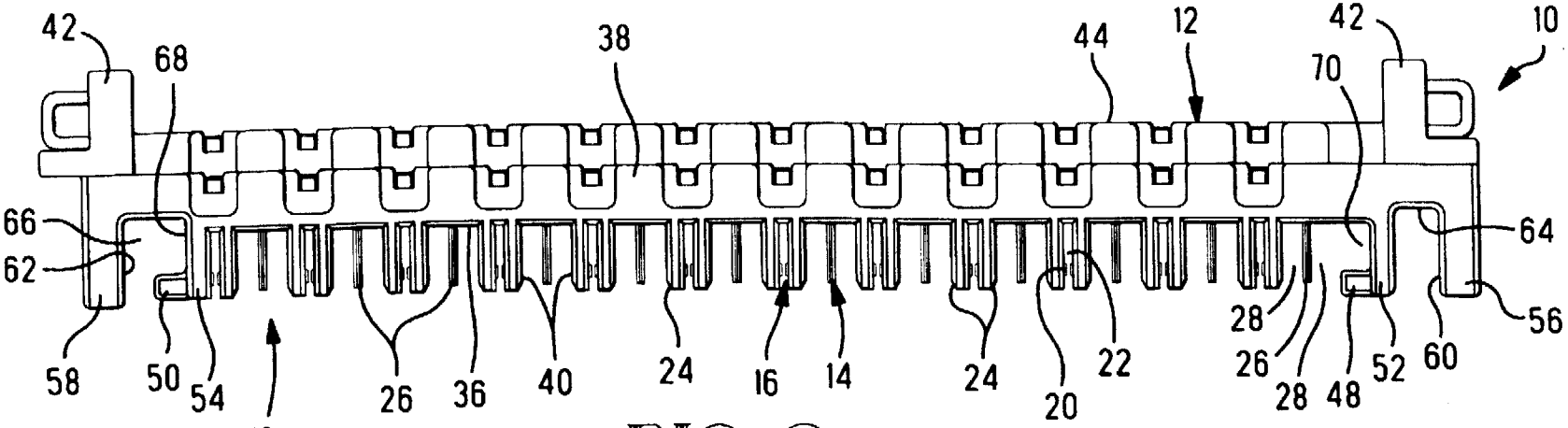
FIGS. 1 to 3 are elevation, top plan and side views of the connector of the present invention, with FIG. 1 showing the mating face.
Figure 1:
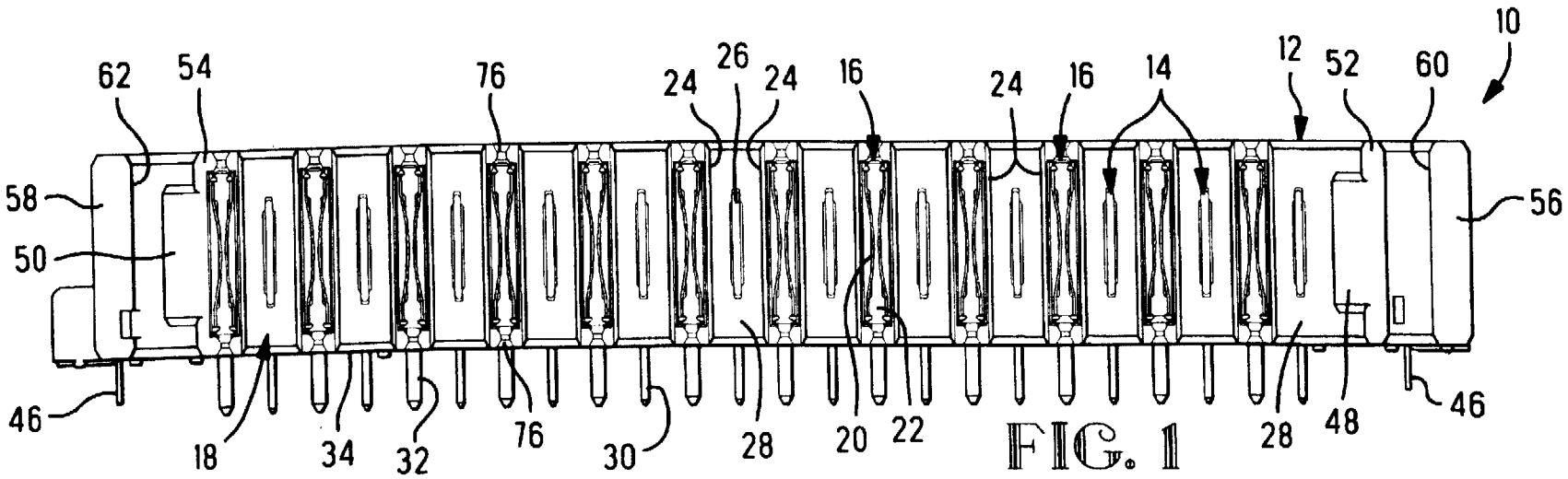

Connector 10 in FIG. 1 is shown from the front to illustrate the mating face, and has an insulative housing 12 and male or blade contacts 14 alternating with female or receptacle contacts 16 along mating face 18. Receptacle portions 20 of contacts 16 are disposed in blade-receiving slots 22 of protective projections 24, while blade portions 26 are disposed in recesses 28 between adjacent projections 24. Pin contact portions 30,32 of contacts 14,16 are seen depending from board-mounting face 34 of connector 10 to be received into through-holes of a circuit board (not shown) for electrical connection to circuits thereof. In FIG. 2 it can be seen that the mating face is defined by blade portions 26 protruding from generally coplanar surfaces 36 of body section 38 of housing 12 midway between facing sidewalls 40 of adjacent projections 24 that define recesses 28. Receptacle portions 20 are seen to protrude into the blade-receiving slot 22 sufficiently to assure engagement of an associated blade portion of a mating connector (see FIG. 4).

Figure 3:
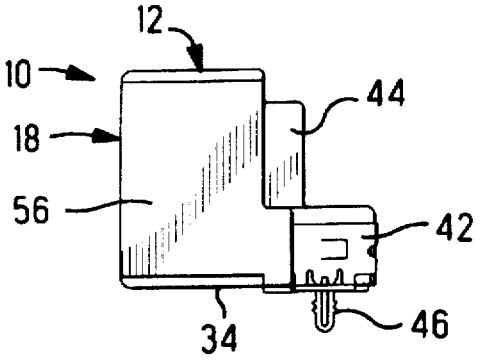

Along rear face 42 are seen mounting flanges 44 at each end including board retention members 46 depending from board mounting face 34 (see FIG. 3). At each end of the mating face 18 are seen a key 48,50 extending in a common lateral direction from an end projection 52,54. Outwardly of keys 48,50 and end projections 52,54 are end walls 56,58 having inwardly facing surfaces 60,62 facing a vertical clearance 64,66. Vertical clearance 64 communicates with a clearance portion 68 rearwardly from key 50, while a clearance portion 70 is defined rearwardly from key 48 adjacent an inner surface of end projection 52 and opening onto a recess 28 containing a blade portion 26.

It can be seen from FIGS. 1, 2, 4 and 22 that the mating face is so defined that connector 10 is matable with another connector having a like mating face with like blade portions, receptacle portions and projections and recesses. Keys of the other connector are receivable into the clearance portions 68,70 of connector 10 and vice versa, and end projections 52,54 containing keys 48,50 are receivable into either a vertical clearance or a blade-containing recess. End walls 50,52 are received either into a vertical clearance or outwardly of a corresponding end wall of the other connector.

Figure 4:
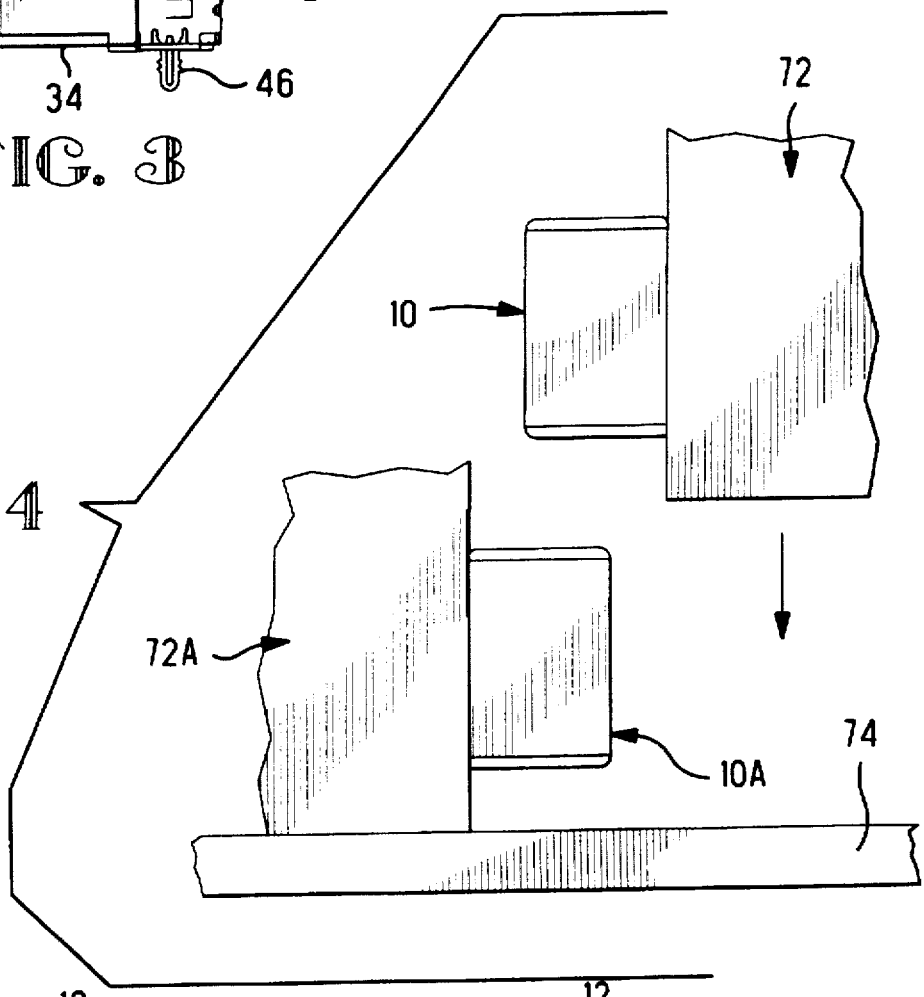
FIG. 4 is a diagrammatic representation in side view of a pair of electronic modules being assembled in an array and each having a connector of FIGS. 1 to 3 along an opposed side surface thereof.

As illustrated in FIG. 4, it can also be discerned that mating of the connectors is accomplished by transverse vertical movement of the connectors 10,10A. In FIG. 4, connector 10 is shown extending from an end of a housing 72 of an electronics module containing a circuit board to which the connector is mounted, while like connector 10A is extending from an end of module housing 72A, with the housings being movable only vertically to be positioned in a closely spaced array along a common mounting surface 74 such as a DIN rail. Interfitting of the end walls and end projections and keys and clearances assures that the connectors are precisely aligned laterally and sufficiently precisely spaced so that the blade portions of each connector are aligned with corresponding blade-receiving slots and receptacle portions of the other enabling assured electrical engagement. Preferably all corners of housing 12 are chamfered where engagement with the housing of the mating connector is likely, as is conventional, as well as at narrow entrances 76 to blade-receiving slots 22.

Figure 5:
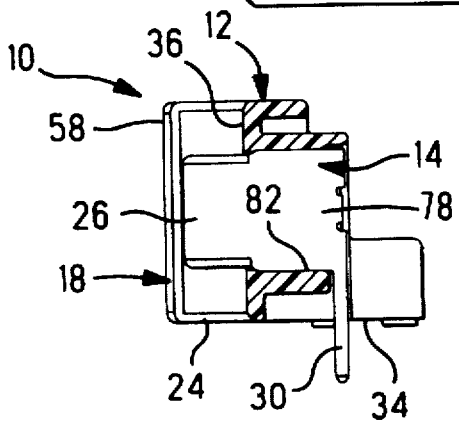
FIGS. 5 and 6 are cross sectional views of the connector of FIGS. 1 to 3, with FIG. 5 showing a blade contact and being taken along lines 5—5 of FIG. 1, and FIG. 6 showing a receptacle contact and taken along lines 6—6 of FIG. 1.
Figure 8:
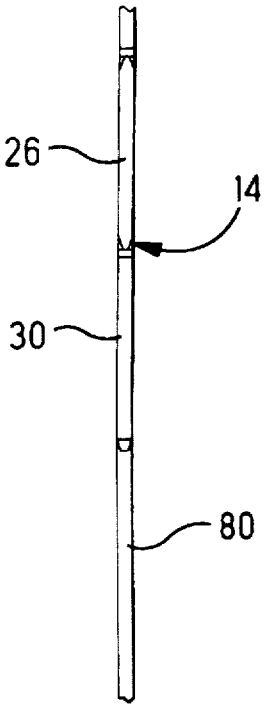
FIGS. 7 and 8 are a side view and a front view of a blade contact of the present invention.
Figure 7:
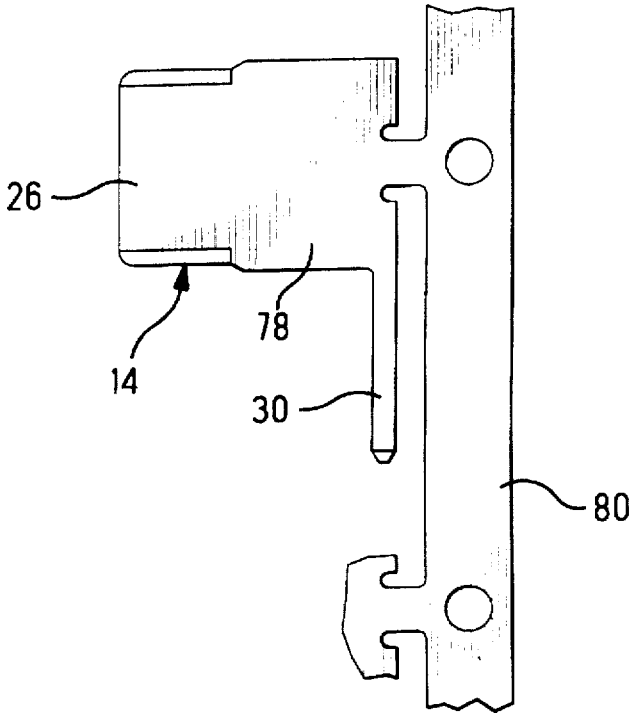

Referring now to FIGS. 5, 7 and 8, blade contact 14 is seen to have blade portion 26 extending forwardly from body portion 78 with pin portion 30 depending therefrom, all defining a planar member, shown on a carrier strip 80 in FIG. 7. The contact is insertable in an interference fit through a slot 82 through housing body 38 and beyond surface 36 to be disposed within a recess 28.

Figure 6:
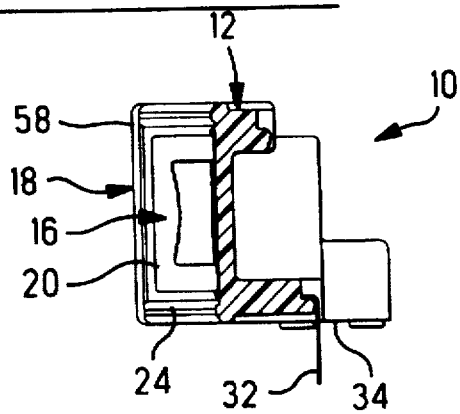
Figure 9:
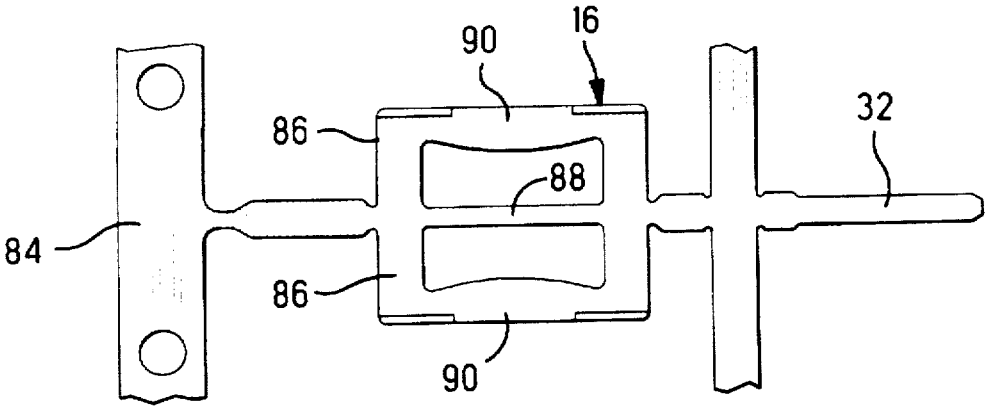
FIGS. 9 to 14 show the stamping and forming of a receptacle contact of the present invention.
Figure 10:
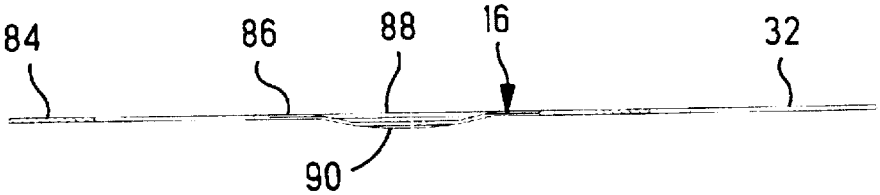
Figure 14:
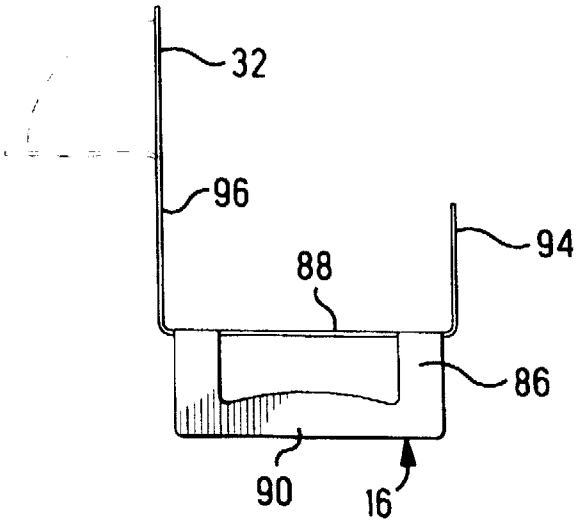
Figure 13:
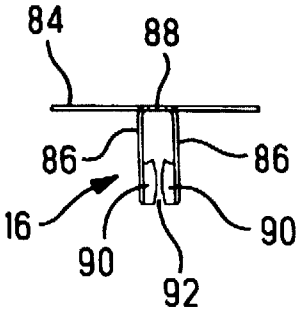
Figure 11:
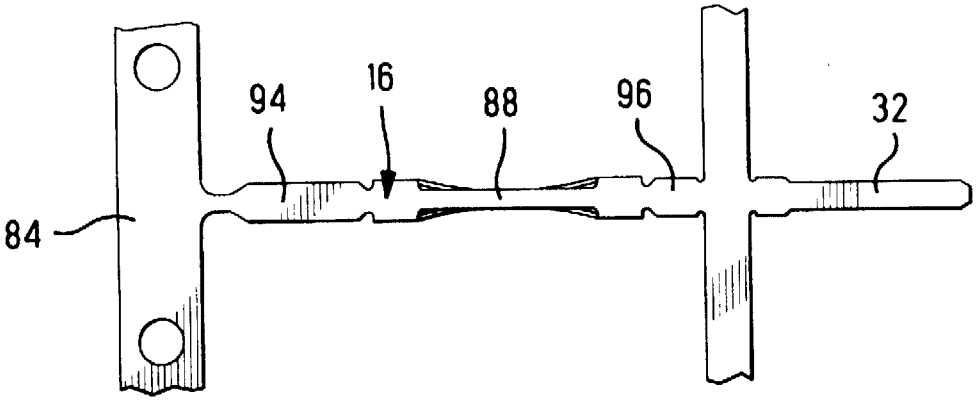
Figure 12:
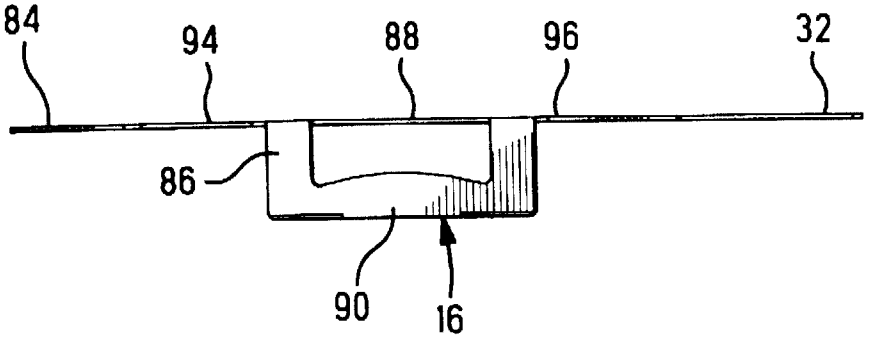

Referring to FIGS. 6 and 9 to 14, receptacle contact 16 is seen to have a receptacle portion 20 that is stamped and formed preferably on carrier strip 84 in a progression. In FIG. 9 a pair of wings 86 are stamped initially in a common plane extending laterally from a body section 88, with pin section 32 extending axially from body section 88. In FIG. 10 it is seen that wings 86 include contact sections 90 that are arcuate out of the plane in a common direction. In FIGS. 11 to 14, wings 86 are bent to extend orthogonally from the plane such that arcuate contact sections 90 face each other to define a blade-receiving gap 92 therebetween, and the receptacle contact 16 is severed from the carrier strip; body section 88 is seen to include upper and lower horizontal body portions 94,96 extending from top and bottom ends of receptacle portion 20, and pin contact section 32 is then bent orthogonally from lower horizontal body portion 96 (FIG. 6).

Figure 17:
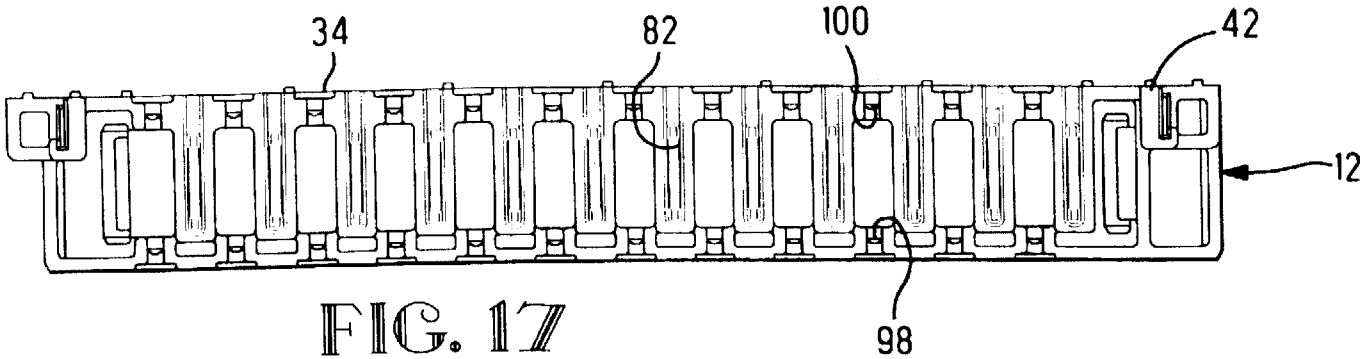
FIGS. 15 to 17 are a front view, top view and bottom view of the housing of the present connector.
Figure 16:
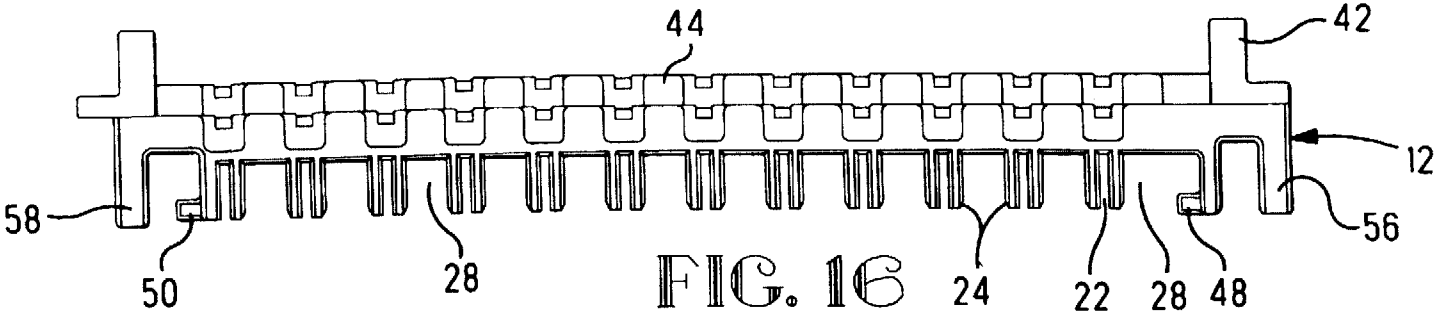
Figure 15:
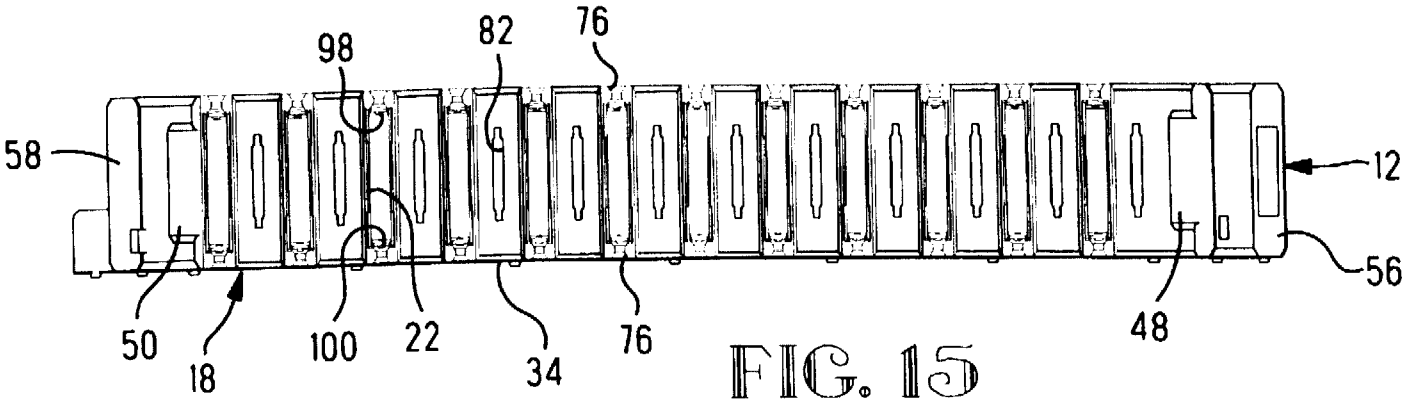
Figure 18:
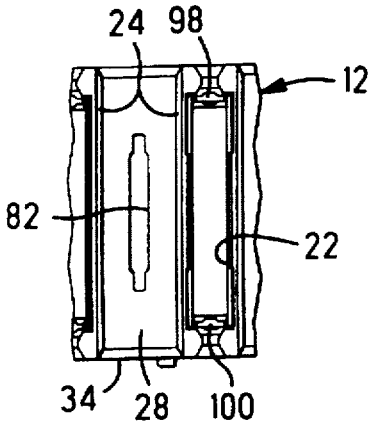
FIGS. 18 to 20 are enlarged views of the connector housing showing blade and receptacle contacts sites of the housing.
Figure 19:
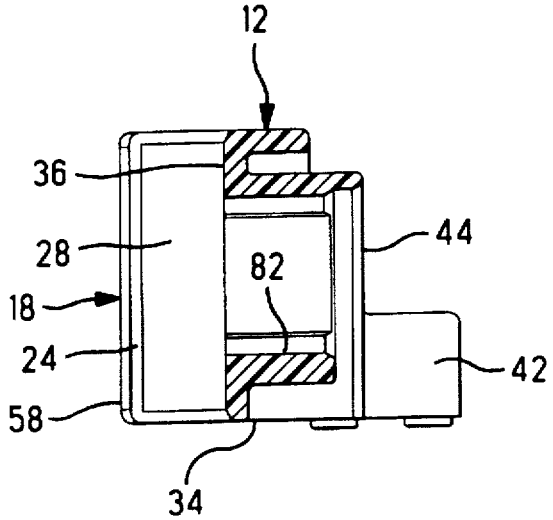
Figure 20:
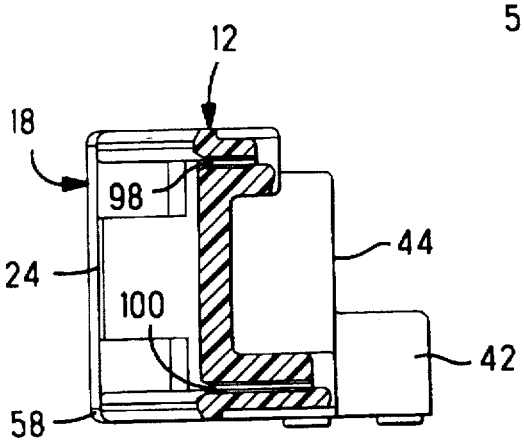
Figure 21:
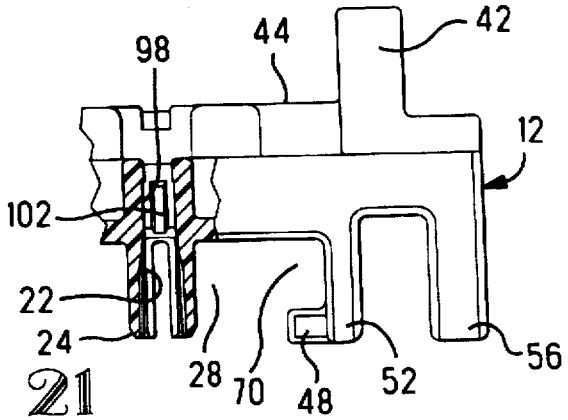
FIG. 21 shows an end portion of the connector housing with part of the housing broken away to illustrate a receptacle contact site from above thereof.

Housing 12 of connector 10 is shown in FIGS. 15 to 22 prior to loading of blade and receptacle contacts and board retention members, in order to more clearly depict the structure thereof. Blade contacts are insertable through slots 82 from rear face 44. Receptacle contacts are insertable from mating face 18 by upper and lower body portions 94,96 inserted in interference fit into respective slots 98,100 extending rearwardly from blade-receiving slot 22. FIG. 17 is a view of the rear face of housing 12, and is inverted with respect to FIG. 15 showing the mating face 18. FIG. 21 is an enlarged view of an end of housing 12 illustrating both a key 48 and related clearance 70, end projection 52 and end wall 56, and also sectioning through a blade receiving slot 22 through a projection 24 and showing upper slot 98 through which upper body section 94 of a receptacle contact 16 will be inserted. Seen in upper slot 98 is an embossment 102 that assists in establishing the interference fit with upper body section 94, with a similar embossment utilized in lower slot 100.

Figure 22:
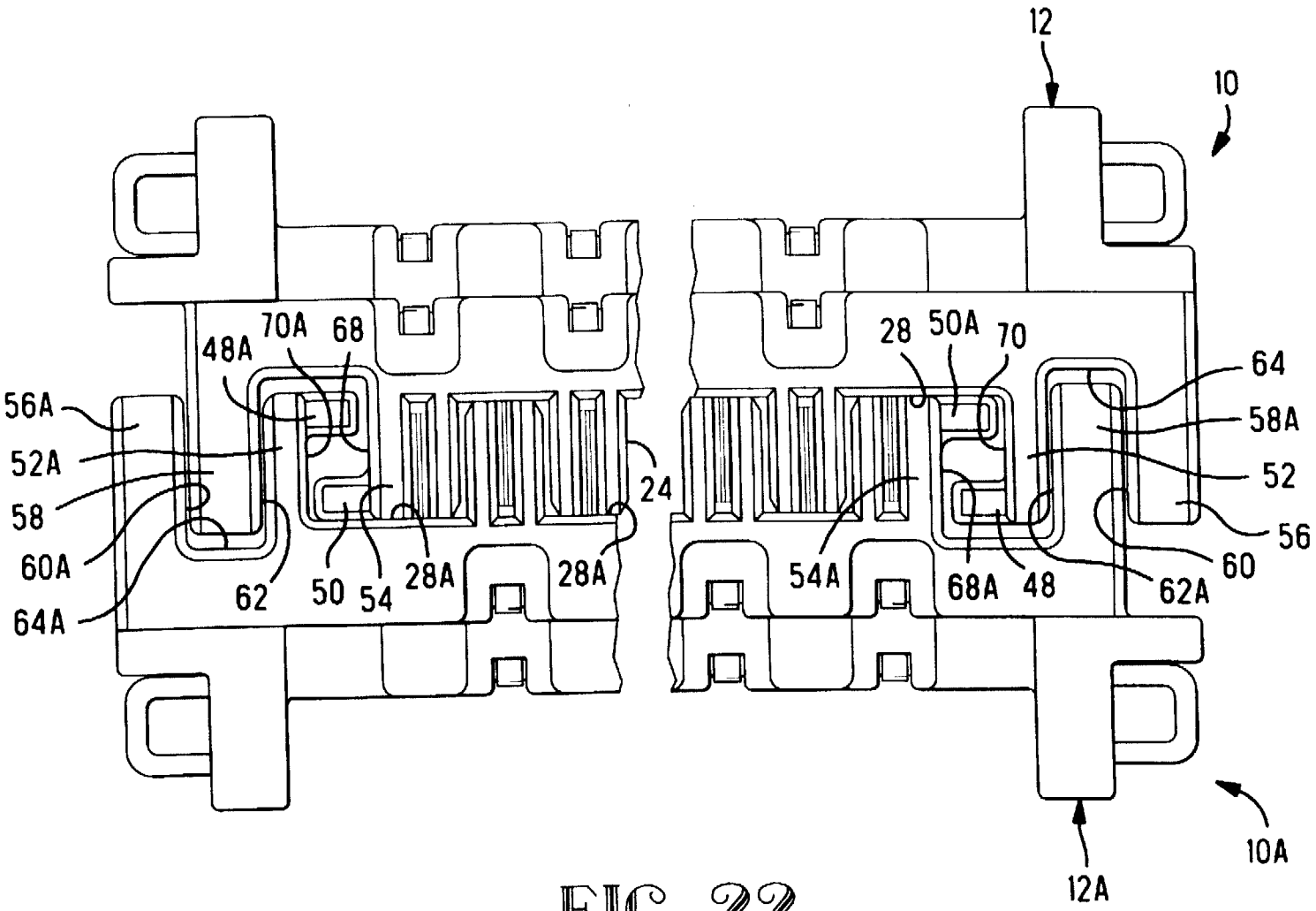
FIG. 22 is a plan view of a pair of connectors of the present invention in mated relationship.

FIG. 22 shows a connector 10 and a like connector 10A having been mated, with housing 12 having projections 24 received into recesses 28A of housing 12A, and vice versa, and their respective contacts in mated relationship. Keys 48,50 of connector 10 are received into clearances 68A,70A of connector 10A, and keys 48A,50A of connector 10A into clearances 68,70 of connector 10; end projections 52,54 of connector 10 received into clearance 62A and recess 28A of connector 10A, and end projections 52A,54A into clearance 62 aand recess 28; end wall 58 is received into vertical clearance 64A while end wall 56 is disposed outwardly of end wall 58A, and end wall 56A is received into vertical clearance 64.

The embodiment disclosed herein is an hermaphroditic connector having alternating blade and receptacle portions. Rearward portions of the housings remote from the mating faces need not be identical in order for the identical mating faces to be mated in accordance with the present invention.

The present invention may also be utilized wherein the blade portions are spaced apart at a first end of a row, and the receptacle portions are positioned in slotted projections at a second end of the row, such that a like connector is matable therewith having its receptacle portions aligned with the blade portions, and its blade portions aligned with the receptacle portions. Similarly the blade portions, and the receptacle portions in respective projections, may be arranged other than a true alternating fashion along the row, but spaced consistently so that a like connector may be matable therewith once positioned in an appropriate orientation.

Other variations and modifications may occur that are within the spirit of the invention and the scope of the claims.

What is claimed is:

1. An electrical connector comprising:

an insulative housing including a body portion and a mating face, said housing including at least one projection extending from said body portion at said mating face and having opposed first and second side surfaces and opposed third and fourth sides orthogonal thereto, each said at least one projection including a slot thereacross orthogonal to said first and second side surfaces and in communication therewith and defining blade-receiving entrances therealong;

at least one first contact disposed in said body section and including a blade portion extending therefrom at said mating face parallel to said third and fourth sides of said projection and spaced therefrom; and at least one second contact disposed in said body section and including a receptacle portion extending therefrom at said mating face to be disposed within said slot of a respective said projection;

each said receptacle portion having a blade-receiving gap adjacent said blade-receiving gap of said slot and aligned therewith, whereby said connector is adapted to be matable with another connector having contacts with like blade portions corresponding with said receptacle portions and further having contacts with like receptacle portions corresponding with said blade portions, with said connector and said another connector movable relatively transversely with respect to said mating face.

2. A connector as set forth in claim 1 wherein key projections extend in a common direction from respective end projections forwardly of clearances therebehind and spaced from adjacent structure, all so that like keys of said like connector on like end projections have clearance to be interfitted upon said connector and a like connector being moved relatively transversely and preventing relative connector movement axially apart orthogonally to the mating face.

3. An electrical connector comprising:

an insulative housing including a body portion and a mating face, said housing including a row of projections extending from said body portion along said mating face each having opposed first and second side surfaces parallel to said row, said projections spaced from each other a distance slightly greater than a width thereof to define recesses therebetween;

a plurality of first contacts retained in said body portion and having blade portions coextending in parallel therefrom at said mating face in said row with said blade portions being orthogonal to said row and disposed within respective said recesses; and a like plurality of second contacts retained in said body portion and having receptacle portions coextending in said row from said body portion and disposed within respective said projections, said projections including respective slots thereacross transverse of said mating face and communicating with said opposed first and second side surfaces with said slots being parallel to said blade portions and orthogonal to said row, and said receptacle portions being disposed within respective said slots, said slots and said receptacle portions being adapted for the receipt of respective blade portions of a mating connector movable thereinto from positions along either of said first and second side surfaces of said projections in a direction parallel to said blade portions, whereby said connector is matable with a like connector movable transversely from either one of said first and second sides of said row of projections, with said projections receivable into corresponding recesses of said like connector, said blade portions matable with corresponding receptacle portions of said like connector upon entering respective said slots of said projections, and said receptacle portions matable with corresponding blade portions of said like connector.

4. A connector as set forth in claim 3 wherein said blade portions and receptacle portions alternate along said row, and each said blade portion is disposed in a recess between adjacent said projections, with each recess being sufficiently wide to receive a said projection of said like mating connector thereinto from laterally thereof.

5. A connector as set forth in claim 3 wherein key projections extend in a common direction from respective end projections forwardly of clearances therebehind and spaced from adjacent structure, all so that like keys of said like connector on like end projections have clearance to be interfitted upon said connector and said like connector being moved relatively transversely and preventing relative connector movement axially apart orthogonally to the mating face.

6. A connector as set forth in claim 3 wherein each said receptacle portion comprises a pair of arcuate contact sections on opposed wings coextending from a common body section, defining therebetween a blade-receiving gap having entrances at ends of the receptacle portion, said arcuate contact sections having opposed blade-engaging contact surfaces converging toward each other midway between said ends and being spaced slightly apart to engage a blade portion inserted thereinto from either of said ends.

7. A connector as set forth in claim 6 wherein each said second contact includes upper and lower horizontal portions coextending rearwardly from top and bottom ends of said receptacle portion to be received into associated slots through said body section of said housing, with said lower horizontal portion including a pin section bent vertically from an end thereof to depend from said housing for electrical engagement with another electrical article.

8. A connector as set forth in claim 7 wherein each said first contact includes a pin section extending vertically from a rearward end thereof to depend from said housing for electrical engagement with another electrical article.

9. A connector as set forth in claim 7 wherein each said associated slot includes embossments rearwardly from said mating face to establish an interference fit with said upper and lower horizontal body portions of a respective said second contact.

10. An electrical connector comprising:

an insulative housing including a mating face and at least one projection extending from said body portion at said mating face and having opposed first and second side surfaces and opposed third and fourth sides orthogonal thereto, each said at least one projection including a slot thereacross orthogonal to said first and second side surfaces and in communication therewith and defining blade-receiving entrances therealong;

at least one contact in a respective said slot and having a receptacle portion having opposed ends exposed along said third and fourth sides inwardly from respective said blade-receiving entrances, each said receptacle portion includes a pair of arcuate contact sections on opposed wings coextending from a common body section and defining therebetween a blade-receiving gap having entrances at opposed ends of said receptacle portion, said arcuate contact sections having blade-engaging contact surfaces converging toward each other midway between said ends for said contact surfaces to be spaced slightly apart to engage a blade portion inserted thereinto from either of said opposed sides of said housing mating face; and said housing includes key projections extending in a common direction from respective end projections forwardly of clearances therebehind and spaced from adjacent structure, all so that like keys of a mating connector on like end projections have clearance to be interfitted upon said connector and the mating connector being moved relatively transversely and preventing relative connector movement axially apart orthogonally to the mating face.

11. A connector as set forth in claim 10 wherein each said receptacle portion includes upper and lower horizontal portions coextending rearwardly from top and bottom ends of said receptacle portion to be received into associated slots through said body section of said housing, with said lower horizontal portion including a pin section bent vertically from an end thereof to depend from said housing for electrical engagement with another electrical article.

12. An electrical connector comprising:

an insulative housing having parallel projections at a mating face, blade contacts disposed along the mating face and parallel to side surfaces of said projections and therebetween, and receptacle contacts disposed in sloes in said projections and having blade-receiving gaps therein with opposed ends opening in respective directions transverse to the mating face and aligned with openings of said slots, and said housing is matable with a housing of another similar connector from either direction transverse to the mating face, with said similar connector having receptacle contacts and blade contacts corresponding with said blade contacts and receptacle contacts.

* * * * *